US005624051A

United States Patent [19]

Ahern, Jr. et al.

[11] Patent Number: 5,624,051

[45] Date of Patent: Apr. 29, 1997

[54] CONTAINER WITH HANDLES AND COVER

[75] Inventors: Richard B. Ahern, Jr., Akron; Dennis K. Jenkins, Medina, both of Ohio

[73] Assignee: Rubbermaid Incorporated, Wooster, Ohio

[21] Appl. No.: 635,772

[22] Filed: Apr. 22, 1996

Related U.S. Application Data

[63] Continuation of Ser. No. 345,650, Nov. 25, 1994, abandoned.

[51] Int. Cl.[6] ..... B65D 43/04

[52] U.S. Cl. ..... 220/553; 220/556; 220/793; 220/805; 220/281

[58] Field of Search ..... 220/212, 212.5, 220/553, 556, 555, 4.24, 780, 781, 793, 796, 805, 4.21, 4.22, 281

[56] References Cited

U.S. PATENT DOCUMENTS

| | | | |
|---|---|---|---|
| D. 228,867 | 10/1973 | Mallonn | D7/131 |
| D. 229,737 | 1/1974 | Taylor | D7/131 |
| D. 230,342 | 2/1974 | Mallonn | D7/131 |
| D. 230,343 | 2/1974 | Mallonn | D7/131 |
| D. 230,344 | 2/1974 | Taylor | D7/131 |
| D. 230,556 | 3/1974 | Mallonn | D7/131 |
| D. 329,572 | 9/1992 | Krupa | D7/542 |
| D. 344,210 | 2/1994 | Cousins et al. | D7/538 |
| D. 348,001 | 6/1994 | Smith | D9/428 |
| D. 349,005 | 7/1994 | Cousins et al. | D7/543 |

(List continued on next page.)

OTHER PUBLICATIONS

1992 Fall/Holiday Catalog, Tupperware Home Parties of Orlando, Florida; pp. 3 and 13.

1992 Catalog, Anchor Hocking Plastics, P.O. Box 64610, St. Paul, Minnesota, 55164.

1989 Catalog, Dupol–Rubbermaid GmbH, An der Trift 63, D–6072 Dreieich, Germany; pp. 20 and 23.

Sell sheet, Rubbermaid Commercial Products Inc., copyright date 1989; 3124 Valley Ave., Winchester, Virginia 22601.

1986 HPD Catalog, Rubbermaid Commercial Products Inc., 3124 Valley Ave., Winchester, Virginia 22601.

1991 HPD Catalog, Rubbermaid Commercial Products Inc., 3124 Valley Ave., Winchester, Virginia 22601.

P. 37 of a magazine advertisement for the "Reheatables Divided Dish"; date unknown.

*Primary Examiner*—Gary E. Elkins
*Assistant Examiner*—Nathan Newhouse
*Attorney, Agent, or Firm*—Renner, Kenner, Greive, Bobak, Taylor & Weber

[57] ABSTRACT

A container (10) includes a base portion (11) and a cover (12). The base portion (11) has a bottom surface (22) with opposed walls (23, 24, 25, 26) extending upwardly therefrom to form an open top to be closed by the cover (12). A handle (30) is formed on opposed corners (27). A flap (18) is positioned on one of the corners (17) of the cover (12), the corner (17) being selected such that the flap (17) will not be positioned over a corner (27) of the base portion (11) carrying a handle (30). The base portion (11) is also divided by a wall (31) of the shape of an inverted U so that the base portion (11) of one container (10) can be stacked on the base portion of a like container.

16 Claims, 3 Drawing Sheets

U.S. PATENT DOCUMENTS

| | | | |
|---|---|---|---|
| D. 350,843 | 9/1994 | Van Valkenburg et al. | D7/614 |
| D. 352,423 | 11/1994 | Laib | D7/538 |
| 3,526,334 | 9/1970 | Ashton et al. | 220/23.83 |
| 3,708,086 | 1/1973 | Colato | 220/556 |
| 3,719,304 | 3/1973 | Douglas | 220/42 C |
| 3,753,512 | 8/1973 | Curry | 220/43 R |
| 3,809,284 | 5/1974 | Churan | 220/60 R |
| 3,979,015 | 9/1976 | Arfert | 220/307 |
| 3,982,651 | 9/1976 | Braun et al. | 220/4 B |
| 4,190,155 | 2/1980 | Higley | 220/212.5 |
| 4,471,880 | 9/1984 | Taylor et al. | 220/306 |
| 4,493,432 | 1/1985 | Smith | 220/270 |
| 4,535,889 | 8/1985 | Terauds | 220/258 X |
| 4,561,562 | 12/1985 | Trombly | 220/306 |
| 4,660,716 | 4/1987 | McMahon et al. | 220/556 X |
| 4,687,117 | 8/1987 | Terauds | 220/306 |
| 4,693,391 | 9/1987 | Roth | 220/359 |
| 4,709,832 | 12/1987 | Mantyla | 220/306 |
| 4,793,510 | 12/1988 | Arfert et al. | 220/306 |
| 4,795,056 | 1/1989 | Meyers | 220/306 |
| 4,809,868 | 3/1989 | Pomroy | 220/260 |
| 5,111,954 | 5/1992 | Gaudreault | 220/306 X |
| 5,356,026 | 10/1994 | Andress et al. | 220/306 |
| 5,377,860 | 1/1995 | Littlejohn et al. | 220/306 |
| 5,395,003 | 3/1995 | Matsuda | 220/306 X |
| 5,419,451 | 5/1995 | Bitel, Jr. | 220/306 |
| 5,425,467 | 6/1995 | Feer et al. | 220/281 |

CONTAINER WITH HANDLES AND COVER

This application is a file wrapper continuation of U.S. patent application Ser. No. 08/345,650, filed Nov. 25, 1994, now abandoned.

TECHNICAL FIELD

This invention relates to a generally rectangular container, such as that used for food storage, and a cover therefor. More particularly, this invention relates to such a container which has a handle positioned at two diametrically-opposed corners for ease of carrying the container. The cover has a flap positioned on at least one corner such that when the cover is on the container, the flap will be over one of the other two diametrically-opposed of the container so as not to interfere with the handles.

BACKGROUND ART

Plastic containers with covers have become quite popular for storing items, particularly, for example, foodstuffs. As such, it is particularly important that there be a tight seal between the container base and the cover. U.S. Pat. No. 4,471,880 discloses a very popular version of such a container with a tight seal. In fact, the seal afforded by this patented concept is so good that it is often difficult to break the seal and remove the cover from the container.

Oftentimes, a small, generally horizontally-oriented tab is provided on the cover which is intended to be grasped and pulled upwardly by the user to break the seal. Such are often too small to provide the user with a sufficient grip to apply sufficient force to break the seal. Even making the tabs larger is not a feasible solution: first, because more lateral space is undesirably utilized, and, second, because only a generally vertical force is still applied, which force is not the ideal force for breaking the seal. Rather, a horizontal force moment applied to the outer periphery of the cover is more desirable to break the seal afforded by the concept of U.S. Pat. No. 4,471,880.

As a result, covers have recently been designed which have one or more downturned flaps that are elongate in nature to form a vertically-oriented lever. As a flap is flexed outwardly, a horizontal force moment is exerted on the periphery of the cover to break the seal with far less force that was required with the previously utilized horizontal tabs. In fact, even the youngest or oldest of users can readily break the airtight seal utilizing these flaps.

For round containers, usually one circumferentially-located flap will suffice. However, for rectangular or square containers, a flap positioned along any of the four sides is usually not sufficient for easy cover removal. Rather, the flap or flaps are preferably positioned at a corner or corners and usually extend a fairly substantial distance along the sides forming the corner. As such, the lever opening force is distributed along the two sides forming the corner and the seal is more readily broken.

The only major problem with the covers with these flaps is that they cannot readily be used with rectangular containers having conventionally-positioned handles. That is, quite often, particularly for larger containers, handles which extend outwardly from near the top of the container base are provided to assist in transporting the containers, which is especially important when hot items are contained therein. The traditional location for such handles on a rectangular container is on the opposed shorter sides. However, the flap on the cover will interfere with the handles and thus such covers cannot be utilized with conventional rectangular containers.

While the existence of the handles does not prohibit the nesting of the containers which is desirable for purposes of economic shipment, storage, retail display and the like, in containers which have internal walls which divide the container into compartments, such nesting is normally impractical, if not impossible, because of the interference of the dividing walls. Thus, the need exists for a divided, rectangular container which can nest within a like container.

DISCLOSURE OF THE INVENTION

It is thus an object of the present invention to provide a container base and cover therefor whereby the container can have one or more handles and the cover can have one or more opening flaps which do not interfere with the handles.

It is another object of the present invention to provide a container base and cover therefor, as above, which is generally rectangular and yet which does not permit the cover to be placed on the container base so as to cause any interference between the flap and the handles.

Is a further object of the present invention to provide a container base and cover therefor, as above, in which the handles are provided on opposed corners of the base and at least one flap is provided on a corner of the cover such that when the cover is positioned on the base, the flap will be adjacent to a corner of the base not having a handle.

It is an additional object of the present invention to provide a container base and cover therefor, as above, in which the base is divided into compartments in such a way that bases of like containers can still nest within each other.

These and other objects of the present invention, as well as the advantages over existing prior art forms, which will become apparent from the description to follow, are accomplished by the invention hereinafter described and claimed.

In general, a container made in accordance with the concepts of the present invention includes a generally rectangular base portion and a cover. The base portion includes a bottom surface and opposed side walls and opposed end walls extending upwardly from the bottom surface to form an open upper top which can be closed by the cover. The side walls merge with or otherwise intersect the end walls to form corners, and a handle is formed near the open top generally on at least one of two opposed corners. The cover includes a downwardly depending flap on at least one corner thereof such that when the cover is positioned on the base portion to close the open top, the flap is selectively positioned at one of the other two opposed corners of the base portion.

In accordance with another aspect of the invention, a divider wall, in the configuration of an inverted U, extends between opposed side walls to divide the base portion into two compartments. However, despite the presence of the wall, the base portions of these containers can still be stacked and/or nested within each other.

A preferred exemplary container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
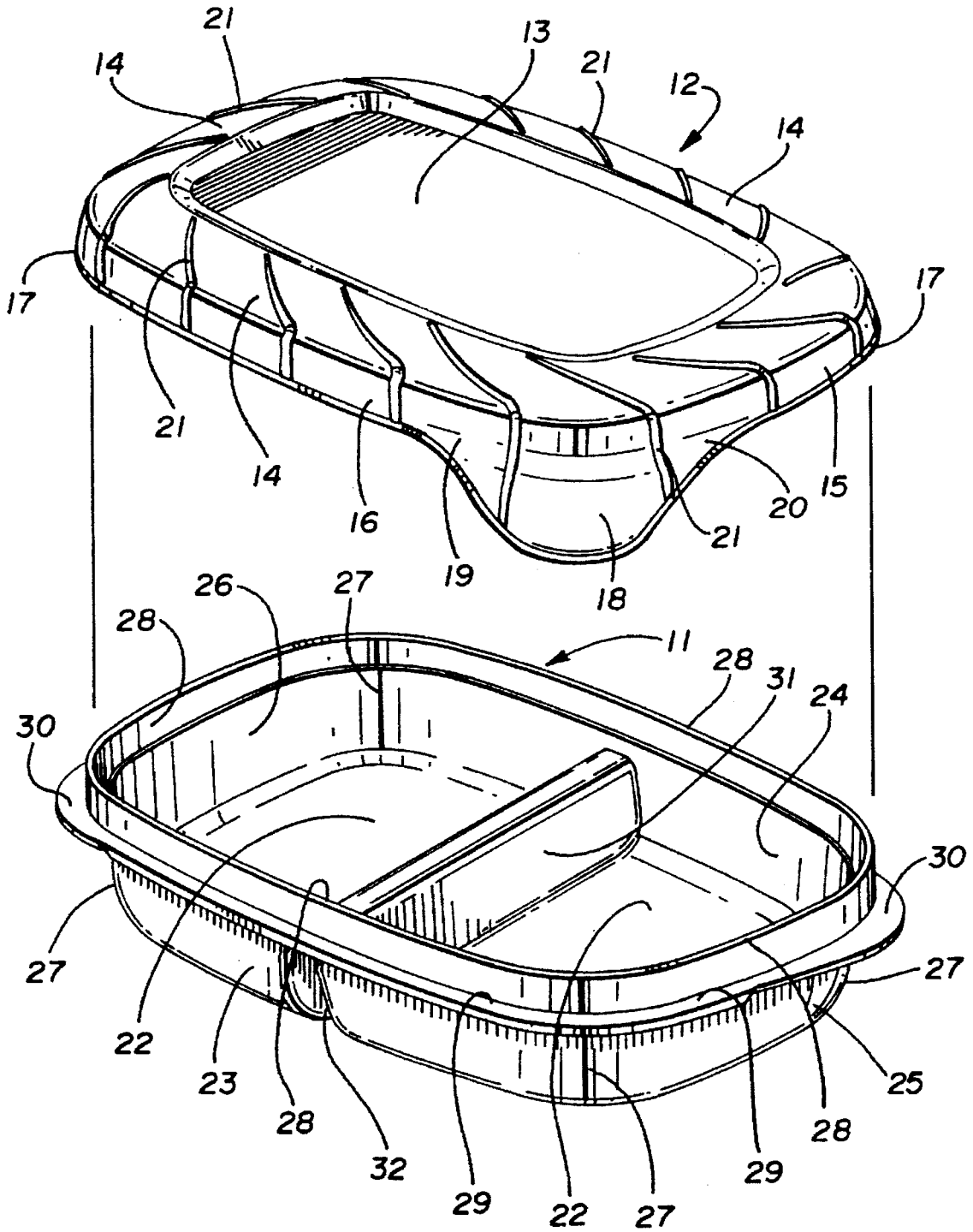
FIG. 1 is an exploded perspective view showing the base portion and cover which together form a container made in accordance with the concept of the present invention.

A container made in accordance with the present invention is indicated generally by the numeral 10 and includes a base portion, generally indicated by the numeral 11, and a cover generally indicated by the numeral 12. Container 10 is preferably molded of a suitable plastic material such as polypropylene.

Cover 12 includes an upper flat surface 13 terminating at its periphery as an upper skirt 14. At the periphery of skirt 14 are downturned end walls 15 and side walls 16. Side walls 16 and end walls 15 generally merge with each other or otherwise form corners 17 therebetween. Corners 17 are shown as being generally rounded primarily for ease of molding. A downturned elongate flap 18 is formed on one corner 17 and downwardly depends therefrom. Flap 18 is utilized to remove cover 12 from base portion 11 and to that end one upper shoulder 19 thereof extends approximately one-third of the length of side walls 16 and the other upper shoulder 20 thereof extends approximately one-half of the length of end wall 15. If desired, another flap 18 may be provided at the diagonally opposite corner 17 of cover 12 without departing from the spirit of the present invention. Finally, with respect to cover 12, fluted ribbing 21 may be provided on skirt 14 and side walls 16, end walls 15 and even flap 18 not only for decorative purposes, but also to provide extra strength to cover 12 as it is flexed onto and off of base portion 11.

Base portion 11 includes a generally flat bottom surface 22 having opposed side walls 23, 24 and opposed end walls 25, 26 extending upwardly therefrom. Side walls 23, 24 and end walls 25, 26 merge to form corners 27 of the generally rectangular base portion 11. Like corners 17 of cover 12, corners 27 are shown as being rounded for ease of molding and, of course, to conform with corners 17. Side walls 23, 24 and end walls 25, 26 terminate as a generally vertically-extending upper lip 28 which forms the open top for base portion 11.

Figure 2:
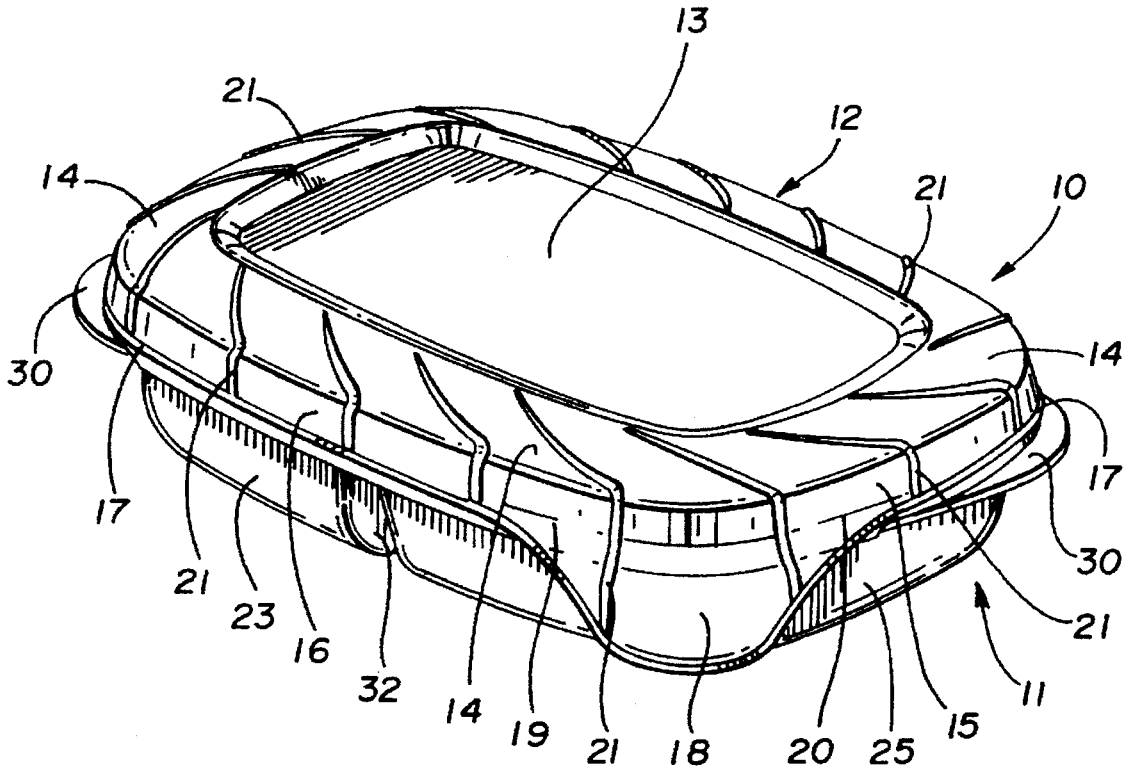
FIG. 2 is a perspective view showing the cover of FIG. 1 positioned on the base portion of FIG. 1 in one of two possible positions.

A generally horizontally-extending peripheral ledge 29 is formed between upper lip 28 and walls 23, 24, 25 and 26. When cover 12 is positioned on base portion 11, as shown in FIG. 2, the lower edges of cover end walls 15 and side walls 16 are generally adjacent to ledge 29 as walls 15 surround the upper lip 28 of base portion end walls 25, 26 and walls 16 surround the upper lip 28 of base portion side walls 23, 24. Cover 12 may thus engage lip 28 in any suitable fashion. For example, the sealing arrangement taught in U.S. Pat. No. 4,471,880, to which reference is made for whatever details may be necessary to understand the present invention, may be utilized so that cover 12 sealingly engages base portion 11.

When cover 12 is so positioned on base portion 11, the geometry is such that flap 18 may be positioned over corner 27 formed by the junction of side wall 24 with end wall 26 or corner 27 formed by the junction of side wall 23 and end wall 25, which is the orientation of flap 18 shown in the drawings. Thus, flap 18 cannot be positioned at the other diagonally-opposed corners 27 formed by the junction of side wall 23 and end wall 26, and side wall 24 and end wall 25, respectively. At one, and preferably both, of these corners, a handle 30 may be formed on base member 11. Handles 30 may take on any desired shape, but they are shown as being a convenient arcuate extension of ledge 29. That is, at the two diagonally-opposed corners 27, ledge 29 is arcuately enlarged to extend laterally outward of cover 12 and base portion 11 at the defined corners 27 thereof. It should be evident that no matter at which diametrically-opposed corner 27 flap 18 is positioned, it cannot be a corner 27 having a handle 30 associated therewith. Thus, handles 30 will not interfere with flap 18 which may therefore be conveniently grasped and lifted upwardly to break the seal and open container 10. Handles 30 can extend, however, and are in fact shown as extending, approximately half way along end walls 25, 26 and a smaller distance along side walls 23, 24.

Figure 3:
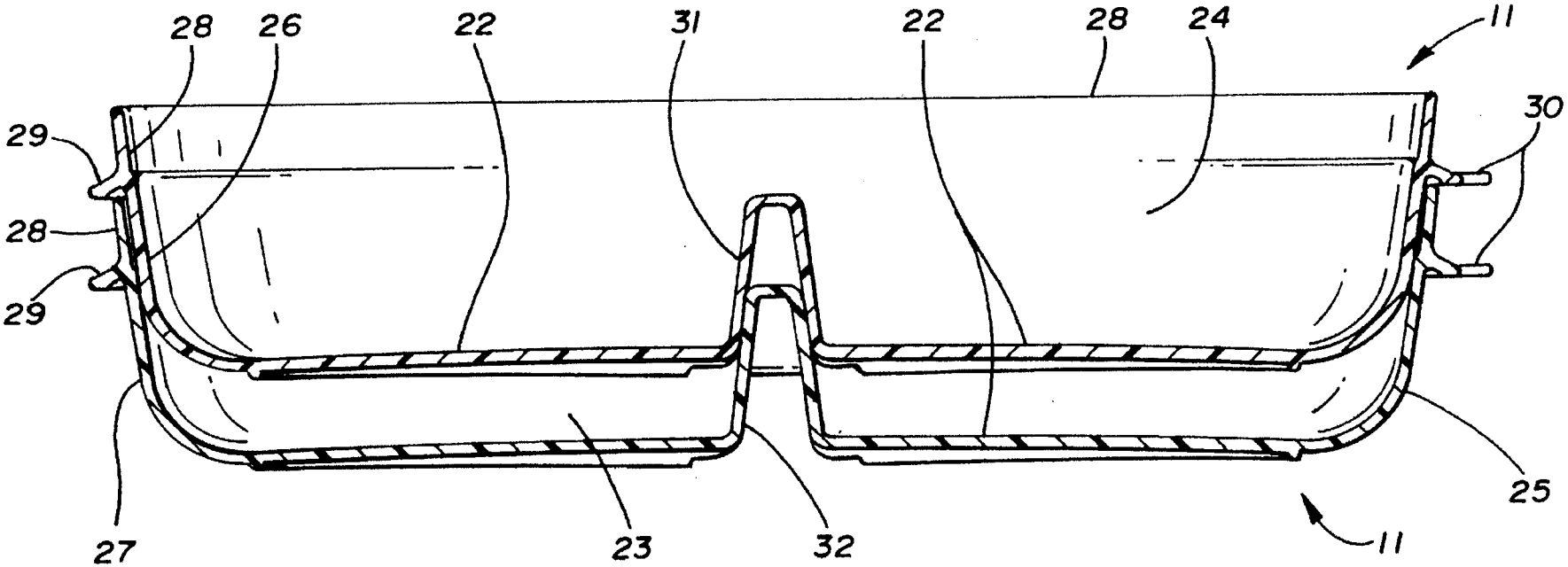
FIG. 3 is a sectional view showing the manner in which containers made in accordance with the present invention can nest.

As shown in FIG. 1, base container portion 11 may also be divided to provide for more than one storage compartment. Thus a divider wall 31 extends laterally between and within side walls 23 and 24 and generally parallel to end walls 25 and 26. Divider wall 31, as shown, can be in the form of an inverted U, thereby forming an opening 32 in the bottom of base surface 22 within the branches of the U-shaped wall 31. As such, as shown in FIG. 3, base container portions 11 may be stacked upon and nested within each other for ease of storage, shipment and retail display; that is, when stacked or nested, the opening 32 of the U-shaped divider wall 31 of the container 10 above will be conveniently received by the divider wall 31 of the container 10 below. Such is accommodated if all generally vertical walls of base portion 11 taper slightly outwardly from bottom to top which is the traditional draft angle needed when molding most plastic parts.

It should thus be evident that a container constructed in accordance with the concepts of the present invention satisfies the objects of the present invention and otherwise substantially improves the container art.

We claim:

1. A generally rectangular container comprising a bottom surface, opposed side walls extending upwardly from said bottom surface, opposed end walls extending upwardly from said bottom surface and intersecting said side walls to form four corners, said side walls and end walls forming an upper open top, a cover for closing said open top, said cover having corners corresponding to said corners formed by said side walls and said end walls, a flap formed only on one said corner of said cover such that when said cover is positioned to close said open top said flap is selectively positioned only at one of two opposed corners formed by said side walls and end walls, said flap extending downwardly from said one corner and being positioned generally parallel to, adjacent to, and spaced from one said side wall and one said end wall, and a handle formed near said open top on at least one of only the other two of said corners formed by said side walls and end walls such that said flap is not located at said one corner.

2. A container according to claim 1 wherein said other two of said corners are diagonally-opposed corners.

3. A container according to claim 1 further comprising a ledge extending generally horizontally outward from said side walls and said end walls near said open top.

4. A container according to claim 3 wherein said open top is formed by a lip at the top of said side walls and end walls, said ledge being positioned below said lip.

5. A container according to claim 3 wherein said handle is formed as an enlarged arcuate portion of said ledge.

6. A container according to claim 1 further comprising a second handle formed on a second of said other two of said corners, said two of said corners being diagonally opposed to each other.

7. A container according to claim 1, said cover including a generally planar upper surface having a periphery, and downturned side walls and end walls at said periphery, said downturned side walls and end walls intersecting to form said corners of said cover.

8. A container according to claim 7 wherein said flap extends alone one said downturned side wall and one said downturned end wall.

9. A container according to claim 8 further comprising a ledge extending generally horizontally outward from said side walls and said end walls which extend upwardly from said bottom surface, said downturned side walls and downturned end walls of said cover being adjacent to and above said ledge.

10. A container according to claim 9 wherein said handle is formed by an arcuate enlargement of said ledge at a location so as not to interfere with said flap.

11. A container according to claim 1 further comprising means in said bottom surface to divide the container into two sections.

12. A container according to claim 11 wherein said means to divide is an inverted, U-shaped wall such that a like container can be positioned on an open container with its said U-shaped wall nested upon the U-shaped wall of the open container.

13. A container comprising a generally rectangular cover; and a generally rectangular base portion adapted to receive said cover; said base portion including a bottom surface, a pair of opposed walls extending upwardly from said bottom surface and forming an open top, adjacent said walls forming a pair of opposed corners, and handles formed near said open top near only one said pair of said opposed corners; said cover having a top surface for closing said open top, a pair of opposed walls downwardly depending from said top surface, adjacent said downwardly depending walls forming a pair of opposed cover corners, and a flap formed only at one said cover corner so that when said cover is placed on said base portion, said flap will not be positioned at the same corner of said base portion as either of said handles; said flap extending downwardly from said one cover corner.

14. A container according to claim 13 further comprising means in said bottom surface to divide said base portion into two sections.

15. A container according to claim 14 wherein said means to divide is an inverted U-shaped wall such that a base portion of a like container can be positioned on said base portion with its U-shaped wall nested upon said U-shaped wall of said base portion.

16. A container comprising a generally rectangular cover; and a generally rectangular base portion receiving said cover; said base portion including a bottom surface, a pair of opposed walls extending upwardly from said bottom surface and forming an open top, adjacent said walls forming a pair of opposed corners, and handles extending generally laterally outwardly from only one said pair of said opposed corners; said cover having a top surface for closing said open top, a pair of opposed walls downwardly depending from said top surface, adjacent said downwardly depending walls forming a pair of opposed cover corners, and a flap extending only from one said cover corner downwardly below said open top, said flap having a shoulder extending along and downwardly from one of said downwardly depending opposed walls of each said pair of downwardly depending opposed walls, said shoulders being spaced from said one of said opposed walls of each said pair of opposed walls.

* * * * *